US009920996B2

(12) United States Patent
Lach

(10) Patent No.: US 9,920,996 B2
(45) Date of Patent: Mar. 20, 2018

(54) HEAT EXCHANGE SYSTEM AND METHOD

(71) Applicant: MAXI-THERME INC., Montreal, Quebec (CA)

(72) Inventor: Raymond Lach, Montreal (CA)

(73) Assignee: MAXI-THERME INC., Montreal, Quebec (CA)

( * ) Notice: Subject to any disclaimer, the term of this patent is extended or adjusted under 35 U.S.C. 154(b) by 351 days.

(21) Appl. No.: 14/631,932

(22) Filed: Feb. 26, 2015

(65) Prior Publication Data

US 2016/0252307 A1 Sep. 1, 2016

(51) Int. Cl.
*F28F 27/00* (2006.01)
*F28B 1/02* (2006.01)
(Continued)

(52) U.S. Cl.
CPC ..... *F28B 1/02* (2013.01); *F28B 11/00* (2013.01); *F28D 7/06* (2013.01); *F28D 21/0017* (2013.01); *F28F 27/02* (2013.01)

(58) Field of Classification Search
CPC .... F28B 1/02; F28B 11/00; F28D 7/06; F28D 21/0017; F28F 27/02
See application file for complete search history.

(56) References Cited

U.S. PATENT DOCUMENTS 651,152 A * 6/1900 Wheeler ..... F01B 25/00 165/302
1,631,162 A * 6/1927 Sebald ..... B01D 1/065 159/13.2
(Continued)

OTHER PUBLICATIONS

Graham, Graham Manufacturing Co., Inc., Graham Bulletin RS109: Recirculation Systems for Micro Mix II Water Heaters, Sep. 11, 1997, pp. 1-2, 15 and 16.
(Continued)

*Primary Examiner* — Travis Ruby
(74) *Attorney, Agent, or Firm* — Shumaker, Loop & Kendrick, LLP; James D. Miller

(57) ABSTRACT

The system and method of controlling a level of flooding to remain substantially constant within a flooded heat exchanger wherein steam flows into a steam side and condenses to form condensate that partly floods the steam side and that flows out of the steam side, and wherein cold water flows into a water side in heat exchange relationship with the steam side to heat the cold water and form heated water that flows out of the water side, comprises collecting the water condensate flowing out of the heat exchanger condensate outlet into a level controller through a controller condensate inlet; connecting the level controller to a steam source having a pressure equivalent to that of the heat exchanger steam side; and controlling the level of condensate in the level controller to remain substantially constant with a controller valve that allows condensate to be exhausted out through a controller condensate outlet if the level of the condensate in the level controller rises beyond a valve activation threshold wherein the level of condensate in the heat exchanger steam side will also be controlled to remain substantially constant consequently allowing a level of flooding in the flooded heat exchanger to remain substantially constant. The heat exchanger heated water outlet can be coupled to a mixer with a further cold water inlet, for obtaining a system and method of providing a determined heated water temperature at a system heated water outlet in a heat exchange system.

4 Claims, 2 Drawing Sheets

(51) Int. Cl.

| | |
|---|---|
| ***F28F 27/02*** | (2006.01) |
| ***F28B 11/00*** | (2006.01) |
| ***F28D 7/06*** | (2006.01) |
| ***F28D 21/00*** | (2006.01) |

(56) References Cited

U.S. PATENT DOCUMENTS

| | | | | | |
|---|---|---|---|---|---|
| 1,778,921 | A * | 10/1930 | Swartz | F22G 5/16 | 165/134.1 |
| 2,001,784 | A * | 5/1935 | Hofmann | F01K 9/00 | 165/278 |
| 2,412,573 | A * | 12/1946 | Fraser, Jr. | F28D 7/1638 | 165/110 |
| 2,533,141 | A * | 12/1950 | Roswell | F24D 1/005 | 159/44 |
| 2,540,293 | A * | 2/1951 | Roswell | F24D 1/005 | 165/108 |
| 2,576,843 | A * | 11/1951 | Lockman | F28B 1/02 | 134/22.12 |
| 3,590,912 | A * | 7/1971 | Elder | F22D 1/32 | 165/111 |
| 2004/0154786 | A1* | 8/2004 | Lach | F28B 1/02 | 165/110 |

OTHER PUBLICATIONS

Graham, Vacuum and Heat Transfer, Graham Manufacturing Co., Inc., Micro-Mix II Instantaneous Steam Water Heaters, Mar. 1997.

* cited by examiner

HEAT EXCHANGE SYSTEM AND METHOD

FIELD OF THE INVENTION

The present invention relates to a heat exchange system and method, and more particularly to a heat exchange system and method that enables providing a determined heated water temperature at a system heated water outlet and maintaining a substantially constant level of flooding within a flooded heat exchanger.

BACKGROUND OF THE INVENTION

Flooded heat exchangers are known for use in heat exchange systems such as for heating water, such as in hotels or industrial environments. A flooded heat exchanger comprises a water side and a steam side that are in heat exchange communication with each other, for heating the water with the steam through heat exchange in respective, distinct fluid circuits. As the steam flows through the steam side it condensates to form condensate that flows out of the heat exchanger. The change of phase of the gaseous steam into liquid condensate is highly exothermic and allows the transfer of a significant quantity of energy from the steam to the water to be heated. A valve is installed on the steam side, at the outlet of the heat exchanger, to control the level of condensate being outputted. This allows the level of condensate to be adjusted on the steam side: if the proportion of steam on the steam side is more important, the heat transfer will be more important due to the hotter steam transferring more energy to the water. However, if the condensate is proportionately more important, then the heat transfer will be less important. The variation in the level of condensate on the steam side, is called the level of flooding of the heat exchanger. It is known to calibrate the level of flooding to adjust the heat exchange, to accommodate variations in the demand in hot water on the water side.

These flooded heat exchangers are so-called feedback heat exchangers, in that the temperature at the heated water outlet will be continuously measured to consequently control the control valve to in turn control the level of flooding according to the demand in hot water at the heated water outlet.

One problem with prior art heat exchangers is linked to energy loss related to flash steam at the condensate output line. This energy loss is typically between 3.9% for heat exchangers that operate at 15 psi; to about 6.5% for heat exchangers that operate at 30 psi. The flash steam in the condensate output line is mainly the result of the condensate exiting the heat exchanger at about the saturation temperature. For example, in a heat exchanger that operates at 15 psi, the steam and condensate temperatures are both 250° F., and the energy loss is about 3.9%; while for heat exchangers that operate at 30 psi, the steam and condensate temperatures are both 274° F., and the energy loss is about 6.5%.

SUMMARY OF THE INVENTION

The invention pertains to a heat exchange system comprising a system steam inlet, a system condensate outlet, a system cold water inlet, a system heated water outlet, a flooded heat exchanger and a level controller, said flooded heat exchanger comprising:

- an exchanger steam inlet connected to said system steam inlet;
- an exchanger condensate outlet;

- an exchanger cold water inlet connected to said system cold water inlet;
- an exchanger heated water outlet connected to said system heated water outlet;
- a steam side wherein steam flows in through said exchanger steam inlet and condensate flows out through said exchanger condensate outlet for condensing the steam to form condensate that partly floods said steam side at a condensate level;
- a water side wherein water flows in through said exchanger cold water inlet and out through said exchanger heated water outlet for heating water by a heat exchange with said steam side;

and said level controller comprising:

- a controller condensate inlet connected to said exchanger condensate outlet;
- a controller steam link connected to a steam source having a pressure equivalent to that of said heat exchanger steam side;
- a controller condensate outlet connected to said system condensate outlet; and
- a controller valve for selectively allowing condensate out through said controller condensate outlet;

wherein said condensate level in said heat exchanger steam side will be controlled to remain substantially constant by said controller valve selectively controlling condensate output through said controller condensate outlet.

In one embodiment, said controller steam link is connected to said steam side of said heat exchanger through a heat exchanger steam link, wherein said steam source is said heat exchanger steam side above said condensate level.

In one embodiment, said heat exchange system further comprises a mixer installed between said exchanger heated water outlet and said system heated water outlet, said mixer comprising:

- a valve heated water inlet connected to said heat exchanger heated water outlet;
- a valve cold water inlet connected to said system cold water inlet;
- a valve heated water outlet connected to said system heated water outlet; and
- a blending valve for controlling a proportion of heated water and cold water to be admixed thereby allowing water to be dispensed at a determined temperature at said system heater water outlet.

In one embodiment, said controller valve comprises a floater for floating in condensate located in said level controller and a plug connected to said floater and continuously biased towards said controller condensate outlet, said plug sealing said condensate outlet if the level of liquid in said level controller remains below a determined valve activation threshold and clearing said condensate outlet if the level of liquid in said level controller increases beyond said valve activation threshold in which case the liquid will carry said floater and said plug upwardly away from said controller condensate outlet.

The present invention also relates to a method of providing a determined heated water temperature at a system heated water outlet in a heat exchange system, said heat exchange system further comprising a system steam inlet, a system condensate outlet, a system cold water inlet, a system heated water outlet, a flooded heat exchanger, a level controller and a mixer, said flooded heat exchanger comprising an exchanger steam inlet, an exchanger condensate outlet, an exchanger cold water inlet and an exchanger heated water outlet, said method comprising the steps of feeding steam from said system steam inlet into a steam side of said heat exchanger wherein steam flows in through said exchanger steam inlet, condensates in said steam side to form condensate that partly floods said steam side and flows out through said exchanger condensate outlet;

circulating water through a water side of said heat exchanger wherein water flows in through said exchanger cold water inlet and out through said exchanger heated water outlet and is heated by a heat exchange with said steam side;

controlling the level of condensate to remain substantially constant within said heat exchanger steam side by:

collecting the condensate flowing out of said heat exchanger condensate outlet into a level controller through a controller condensate inlet;

connecting said level controller to a steam source having a pressure equivalent to that of said heat exchanger steam side; and controlling the level of condensate in said level controller to remain substantially constant with a controller valve that allows condensate to be exhausted out through a controller condensate outlet if the level of said condensate rises beyond a valve activation threshold wherein the level of condensate in said heat exchanger steam side will also be controlled to remain substantially constant consequently allowing a level of flooding in said flooded heat exchanger to remain substantially constant;

wherein the water temperature at said exchanger heated water outlet will have a substantially predictable temperature, said method further comprising the step of mixing the heated water exiting said flooded heat exchanger through said heat exchanger heated water outlet with cold water in a determined proportion to obtain said determined heated water temperature at said system heated water outlet.

In one embodiment, the step of mixing the heated water exiting said flooded heat exchanger with cold water is accomplished with a mixer including a blending valve.

In one embodiment, the step of connecting said level controller to said steam source is accomplished by connecting said steam side of said heat exchanger to said level controller, wherein said steam source is said heat exchanger steam side above said condensate level.

The invention also relates to a method of controlling a level of flooding to remain substantially constant within a flooded heat exchanger, said flooded heat exchanger comprising an exchanger steam inlet, an exchanger condensate outlet, an exchanger cold water inlet and an exchanger heated water outlet, said method comprising the steps of:

feeding steam into a steam side of said heat exchanger wherein steam flows in through said exchanger steam inlet, condensates in said steam side to form condensate that partly floods said steam side and that flows out through said exchanger condensate outlet;

circulating water through a water side of said heat exchanger wherein water flows in through said exchanger cold water inlet and out through said exchanger heated water outlet and is heated by a heat exchange with said steam side;

controlling the level of condensate to remain substantially constant within said heat exchanger steam side by:

collecting the condensate flowing out of said heat exchanger condensate outlet into a level controller through a controller condensate inlet;

connecting said level controller to a steam source having a pressure equivalent to that of said heat exchanger steam side;

controlling the level of condensate in said level controller to remain substantially constant, with a controller valve that allows condensate to be exhausted out through a controller condensate outlet if the level of said condensate in said level controller rises beyond a valve activation threshold wherein the level of condensate in said heat exchanger steam side will also be controlled to remain substantially constant consequently allowing a level of flooding in said flooded heat exchanger to remain substantially constant.

In one embodiment, the step of connecting said level controller to said steam source is accomplished by connecting said steam side of said heat exchanger to said level controller, wherein said steam source is said heat exchanger steam side above said condensate level.

The present invention further relates to a method of controlling a level of flooding to remain substantially constant within a flooded heat exchanger wherein steam flows into a steam side and condenses to form condensate that partly floods said steam side and that flows out of said steam side, and wherein cold water flows into a water side in heat exchange relationship with said steam side to heat the cold water and form heated water that flows out of said water side, said method comprising:

collecting the condensate flowing out of said heat exchanger condensate outlet into a level controller through a controller condensate inlet;

connecting said level controller to a steam source having a pressure equivalent to that of said heat exchanger steam side; and controlling the level of condensate in said level controller to remain substantially constant with a controller valve that allows condensate to be exhausted out through a controller condensate outlet if the level of said condensate in said level controller rises beyond a valve activation threshold wherein the level of condensate in said heat exchanger steam side will also be controlled to remain substantially constant consequently allowing a level of flooding in said flooded heat exchanger to remain substantially constant.

In one embodiment, the step of connecting said level controller to said steam source is accomplished by connecting said steam side of said heat exchanger to said level controller, wherein said steam source is said heat exchanger steam side above said condensate level.

DETAILED DESCRIPTION OF THE EMBODIMENTS

Figure 1:
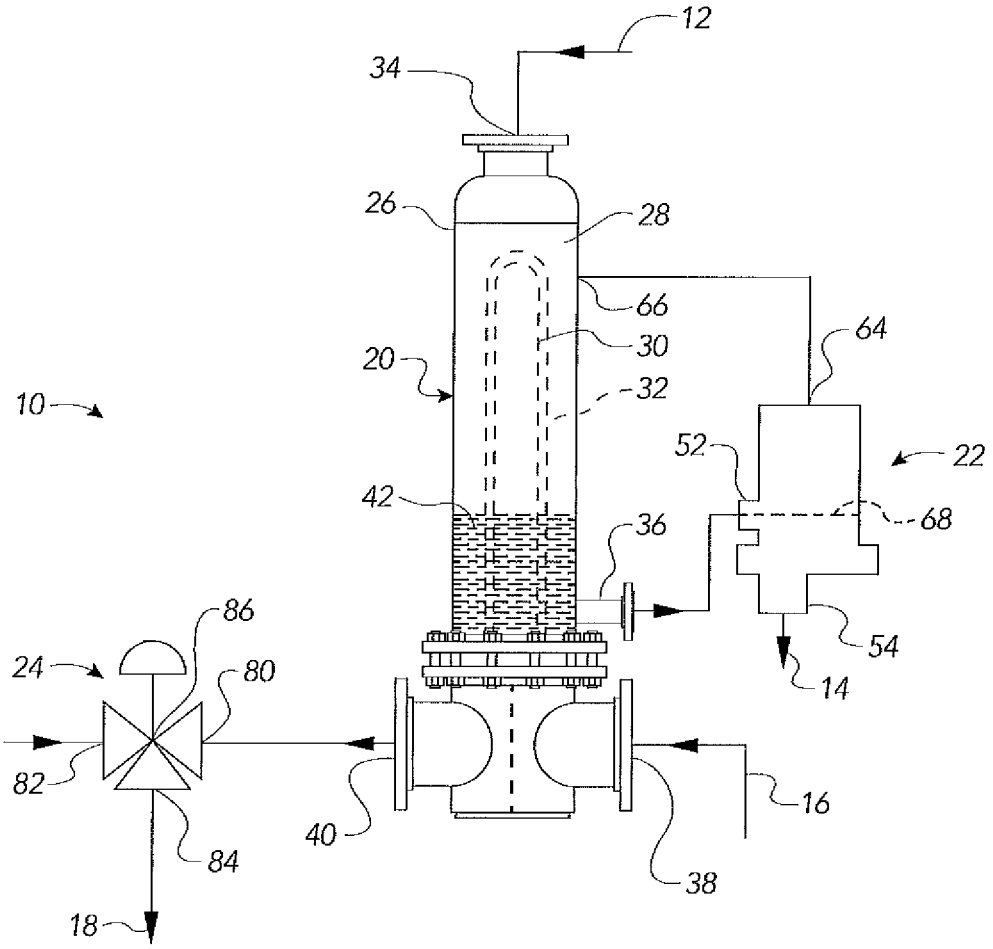
FIG. 1 is a schematic view of the heat exchange system according to the present invention.

FIG. 1 shows a heat exchange system 10 according to the present invention for heating water at a determined water temperature, irrespective of variations in water demand; with a flooded heat exchanger in which the level of flooding is controlled to remain substantially constant.

Heat exchange system 10 comprises a system steam inlet 12, a system condensate outlet 14, a system cold water inlet 16, a system heated water outlet 18, a flooded heat exchanger 20, a level controller 22 and a mixer 24.

Flooded heat exchanger 20 comprises an exchanger reservoir 26 in which steam and water can flow in two distinct fluid channels or circuits, namely a steam side 28 and a water side 30 that are distinct fluid circuits without any fluid mixture therebetween; while steam side 28 and water side 30 are in thermally conductive contact with each other to allow heat exchange between each other. Steam side 28 may comprise baffles (not shown) and allows steam to circulate outside of a number of tubes 32 that compose water side and wherein the water to be heated circulates. A single tube 32 is shown in the schematic view of FIG. 1, but it is understood that heat exchangers conventionally comprise numerous tubes 32. Also, the tubes 32 are shown to be U-shaped, but straight tubes could alternately be used by using a different heat exchanger design. More generally, different tube and shell configurations can be used without departing from the scope of the present invention. For example, the steam could alternately flow in the tubes while the water to be heated flows through the shell side. Or, other types of heat exchangers could be used instead of a shell and tube type heat exchanger, for example a plate and frame type heat exchanger or any other suitable heat exchanger design.

Heat exchanger 20 comprises an exchanger steam inlet 34 connected to system steam inlet 12 and allowing steam into steam side 28, and an exchanger condensate outlet 36 allowing condensate to exit heat exchanger steam side 28. Heat exchanger 20 further comprises an exchanger cold water inlet 38 connected to system cold water inlet 16 for allowing cold water into the heat exchanger water side 30, and an exchanger heated water outlet 40 connected to system heated water outlet 18 albeit indirectly as detailed hereinafter. Water flowing in water side 30 can consequently be heated by the steam/condensate flowing in steam side 28 through a heat exchange between the water and steam/condensate. Heat exchanger 20, combined to level controller 22, is adapted, by calibrating its size and operational parameters, for allowing a heat exchange that will cause the steam to condensate to thereby partly flood the steam side, causing the condensate to rise at a condensate level 42. Heat exchanger 20 is consequently of the so-called flooded heat exchanger type.

Figure 2:
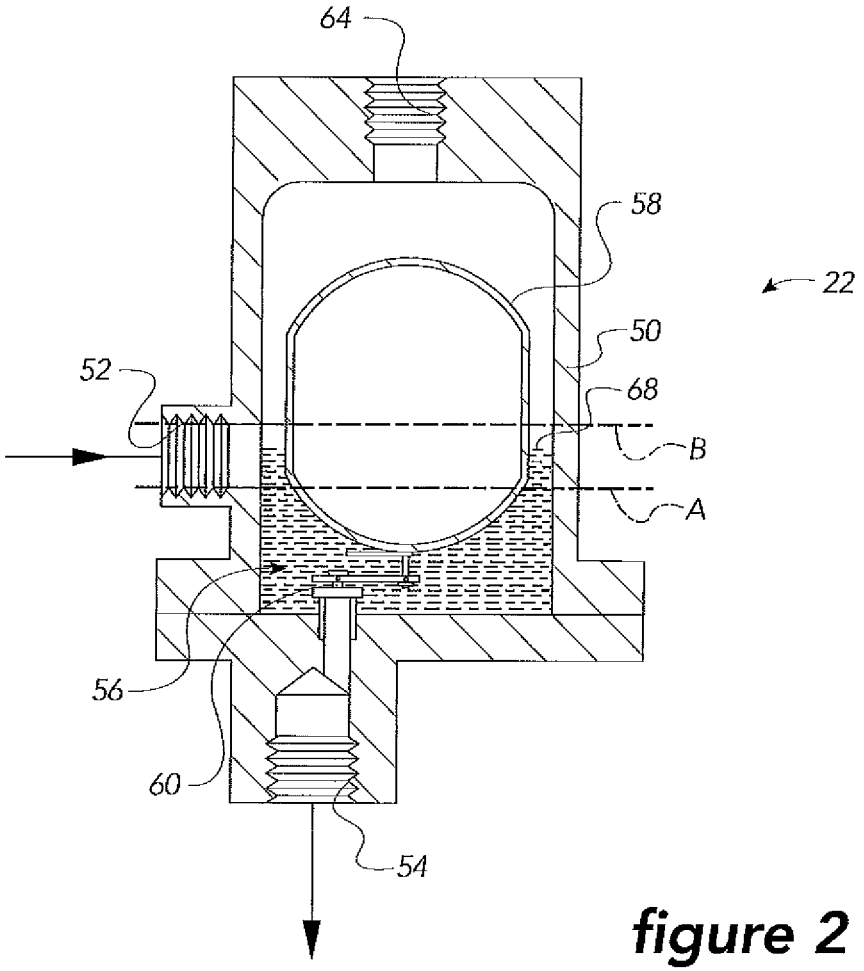
FIG. 2 is an enlarged schematic view of the level controller of the heat exchange system of FIG. 1.

Level controller 22, also shown in FIG. 2, comprises a controller reservoir 50 that has a controller condensate inlet 52 connected to exchanger condensate outlet 36, a controller condensate outlet 54 connected to system condensate outlet 14 and a controller valve 56 for selectively allowing condensate out through controller condensate outlet 54.

Controller valve 56 comprises a floater 58 for floating in condensate located in level controller 22, a plug 60 connected to floater 58. Plug 60 is continuously biased towards controller condensate outlet 54 by the pressure in level controller 22 such that plug 60 will seal condensate outlet 54 if the level of liquid in level controller 22 falls below a determined valve activation threshold; and will clear condensate outlet 54 if the level of liquid in level controller 22 increases beyond the valve activation threshold. Indeed, in this latter case, the liquid-phase condensate will carry floater 58 and plug 60 upwardly and away from condensate outlet 54.

Level controller 22 also comprises a controller steam link 64 connected to an exchanger steam link 66 that is located on the steam side 28 of heat exchanger 20 and more particularly that is located above the condensate level 42 in heat exchanger steam side 28. Consequently, there is a connection allowing pressure equilibrium between level controller 22 and heat exchanger steam side 28 due to the dual connection that comprises:

1) the heat exchanger condensate outlet 36 that is coupled to the level controller condensate inlet 52; and
2) the heat exchanger steam link 66 that is coupled to the level controlled steam link 64.

This pressure equilibrium, together with the floater 58 and valve 60 assembly, allow the level of condensate in level controller 22 to be controlled to remain substantially constant, due to the controller valve 56 that allows condensate to be selectively exhausted out through controller condensate outlet 54 as a result of the level of condensate within level controller 22 rising beyond said valve activation threshold; while the level of condensate will not be allowed to lower beyond a minimum condensate level that will be the same in heat exchanger 20 and in level controller 22 due to the vertical position of condensate inlet 52 of level controller 22. This control of the level of condensate in level controller 22 consequently concurrently allows the level of flooding in flooded heat exchanger steam side 28 to be controlled to remain substantially constant. Indeed, should the level of condensate 42 in heat exchanger steam side 28 lower, the level of condensate 68 in level controller 22 will also lower due to the pressure equilibrium between the liquid-phase condensate and the gaseous state steam and due to the vertical position of level controller condensate inlet 52, and consequently controller valve 56 will be allowed to lower to block controlled condensate outlet 54 to prevent the level of condensate from further lowering. Conversely, should the level of condensate rise, the condensate will carry floater 58 with it and open condensate outlet 54, allowing condensate to be exhausted. The result is that the level of condensate in heat exchanger steam side 28 will be controlled to remain substantially constant, and by that it is meant that the level of condensate will be controlled to remain between the lowermost level of level controller condensate inlet, as shown by line A in FIG. 2; and the valve activation threshold shown by line B in FIG. 2. This slight variation in condensate level is considered insignificant with respect to the height of heat exchanger 20 and will allow for a substantially constant level of flooding therein. As a result, the temperature of the heated water exiting the heat exchanger heated water outlet 40 will also remain substantially constant, for example between 230° F. and 250° F. in a heat exchanger operating at 15 psi wherein steam will be inputted at 250° F.

These operation parameters in heat exchanger 20 allow for the heat exchanger to work in sub-cooling conditions, namely the condensate outlet temperature will be below the saturation level. This avoids the generation of flash steam and consequently completely negates flash steam energy loss. This in turn allows the condensate to be circulated back toward the boiler without use of a pumping station (as normally used in prior art heat exchanger systems) if the differential pressure across level controller 22 is positive.

Positioning the level controller on the condensate outlet of the heat exchanger effectively creates a flooded heat exchanger system, wherein the level of flooding in heat exchanger 20 will be determined at the outset by calibrating the vertical position of level controller 22 relative to the heat exchanger condensate outlet 36 and as a result of the operating parameters of heat exchanger 20, including its size, the pressure/temperature of steam flowing into steam side 28 and the temperature and debit variation of water flowing into and out of water side 30. This is a novel and ingenious way of flooding heat exchanger 20 and specifically allow heat exchanger 20 to work in the above-mentioned advantageous sub-cooling conditions.

It has been found that use of a level controller in a flooded heat exchange system will cost only about $400; while use of a control valve and its accessories in a feedback heat exchange system costs about $4000. This is a further important advantage brought about by the present invention. One reason for this important cost difference is that the level controller is a simple mechanical device that requires no continuous temperature measurement beyond the initial calibration of the heat exchange system, contrarily to the feedback heat exchange system wherein a temperature sensor with associated controls need to be installed for operation of the heat exchange system, to allow control of the condensate outlet valve as a result of measurement of the temperature at the heated water outlet.'

It is noted that controller steam link 64 could be connected to a steam source other than heat exchanger steam side 28. This steam source would need to have a pressure equivalent to that of heat exchanger steam side 28 for the pressure equilibrium to exist between level controller 22 and heat exchanger steam side 28. For example, controller steam link 64 could be connected to system steam inlet 12 upstream of heat exchanger 20.

Mixer 24 is installed between exchanger heated water outlet 40 and system heated water outlet 18—thereby exchanger heated water outlet 40 is said to be connected to system heated water outlet 18, albeit indirectly. Mixer 24 comprises:

- a mixer heated water inlet 80 connected to heat exchanger heated water outlet 40;
- a mixer cold water inlet 82 connected to system cold water inlet 16 (this connection is not shown in the drawings, but it is understood that it is the same cold water source, although they could be distinct cold water sources in an alternate embodiment);
- a mixer heated water outlet 84 connected to system heated water outlet 18; and
- a blending valve 86 for controlling a proportion of heated water and cold water to be admixed thereby allowing water to be dispensed at a determined temperature at system heater water outlet 18. This proportion of heated/cold water can be continuously varied to obtain a desired water temperature at mixer outlet 84 by determining the temperature of the water at mixer heated water inlet 80 and the mixer cold water inlet 82, and the debit of water required at mixer outlet 84.

Mixer 24, which includes a three-way blending valve 86, could be replaced by any other suitable three-way mixing device such a pneumatic, thermostatic or electric three-way mixing device.

It is noted that although water has been identified herein as the liquid to be circulated on the water side of the heat exchanger, it is understood that any other fluid can be used, for example glycol

What is claimed is:

1. A method of controlling a level of flooding to remain substantially constant within a flooded heat exchanger, said flooded heat exchanger comprising an exchanger steam inlet, an exchanger condensate outlet, an exchanger cold water inlet and an exchanger heated water outlet, said method comprising the steps of:

feeding steam into a steam side of said heat exchanger wherein steam flows in through said exchanger steam inlet, condensates in said steam side to form condensate that partly floods said steam side and that flows out through said exchanger condensate outlet;

circulating water through a water side of said heat exchanger wherein water flows in through said exchanger cold water inlet and out through said exchanger heated water outlet and is heated by a heat exchange with said steam side;

controlling the level of condensate to remain substantially constant within said heat exchanger steam side by:

collecting the condensate flowing out of said heat exchanger condensate outlet into a level controller through a controller condensate inlet;

feeding steam within said level controller through a controller steam inlet by connecting said controller steam inlet to a steam source having a pressure equivalent to that of said heat exchanger steam side;

controlling the level of condensate in said level controller to remain substantially constant, with a controller valve that allows condensate to be exhausted out through a controller condensate outlet if the level of said condensate in said level controller rises beyond a valve activation threshold wherein the level of condensate in said heat exchanger steam side will also be controlled to remain substantially constant consequently allowing a level of flooding in said flooded heat exchanger to remain substantially constant.

2. The method as defined in claim 1, wherein the step of connecting said level controller to said steam source is accomplished by connecting said steam side of said heat exchanger to said controller steam inlet, wherein said steam source is said heat exchanger steam side above said condensate level.

3. A method of controlling a level of flooding to remain substantially constant within a flooded heat exchanger wherein steam flows into a steam side and condenses to form condensate that partly floods said steam side and that flows out of said steam side, and wherein cold water flows into a water side in heat exchange relationship with said steam side to heat the cold water and form heated water that flows out of said water side, said method comprising:

collecting the condensate flowing out of said heat exchanger condensate outlet into a level controller through a controller condensate inlet;

feeding steam within said level controller through a controller steam inlet by connecting said controller steam inlet to a steam source having a pressure equivalent to that of said heat exchanger steam side; and controlling the level of condensate in said level controller to remain substantially constant with a controller valve that allows condensate to be exhausted out through a controller condensate outlet if the level of said condensate in said level controller rises beyond a valve activation threshold wherein the level of condensate in said heat exchanger steam side will also be controlled to remain substantially constant consequently allowing a level of flooding in said flooded heat exchanger to remain substantially constant.

4. The method as defined in claim 3, wherein the step of connecting said level controller to said steam source is accomplished by connecting said steam side of said heat exchanger to said controller steam inlet, wherein said steam source is said heat exchanger steam side above said condensate level.

* * * * *